United States Patent [19]

Masaka et al.

[11] Patent Number: 4,643,653

[45] Date of Patent: Feb. 17, 1987

[54] ELECTROMAGNETIC PUMP

[75] Inventors: Mitusuke Masaka; Takatoshi Arai; Hideo Iwabuchi; Michio Idei, all of Saitama, Japan

[73] Assignee: Jidosha Kiki Co., Ltd., Tokyo, Japan

[21] Appl. No.: 782,285

[22] Filed: Sep. 30, 1985

[30] Foreign Application Priority Data

| | | | |
|---|---|---|---|
| Oct. 15, 1984 | [JP] | Japan | 59-154318[U] |
| Oct. 15, 1984 | [JP] | Japan | 59-154319[U] |
| Oct. 15, 1984 | [JP] | Japan | 59-154321[U] |
| Oct. 25, 1984 | [JP] | Japan | 59-160335[U] |

[51] Int. Cl.[4] ..... F04B 17/04

[52] U.S. Cl. ..... 417/417; 310/30; 361/385

[58] Field of Search ..... 310/30; 417/410, 413, 417/415–417; 361/386, 387, 388, 385; 357/79

[56] References Cited

U.S. PATENT DOCUMENTS

| | | | |
|---|---|---|---|
| 2,469,137 | 5/1949 | Strong | 310/30 X |
| 2,853,656 | 9/1958 | Dowds | 357/79 X |
| 3,261,904 | 7/1966 | Wule | 357/79 X |
| 3,515,966 | 6/1970 | De Valroyer et al. | 417/417 |
| 4,278,406 | 7/1981 | Cooperrides | 417/417 X |
| 4,306,842 | 12/1981 | Masaka | 417/417 |
| 4,496,287 | 1/1985 | Nelson et al. | 417/417 X |
| 4,528,615 | 7/1985 | Perry | 361/386 |
| 4,577,402 | 3/1986 | Swanstrom | 361/386 X |

FOREIGN PATENT DOCUMENTS

| | | | |
|---|---|---|---|
| 464802 | 5/1950 | Canada | 417/417 |

*Primary Examiner*—Carlton R. Croyle
*Assistant Examiner*—Theodore W. Olds
*Attorney, Agent, or Firm*—Blakely, Sokoloff, Taylor & Zafman

[57] ABSTRACT

An electromagnetic pump has a pump housing. The pump housing consists of a cup-like housing body with an outlet cylindrical portion at the center thereof and a lid member having an inlet cylindrical portion at the center thereof. The lid member is fixed to the cup-like housing body. The pump also includes a nonmagnetic sleeve member, a magnetic plunger slidably fitted in the nonmagnetic sleeve member, a return spring for biasing the plunger to a delivery side, inlet and outlet pipes, a coil bobbin arranged around the sleeve member, a transistor assembly consisting of a transistor and a heat sink, a printed circuit board, a holder mounted above the printed circuit board, a leaf spring arranged between the housing body and the holder. A plurality of studs extend on the outer side surface of the flange of the coil bobbin on which the transistor assembly is mounted and on an inner side surface of the holder. The transistor assembly, the printed circuit board and the holder are sequentially stacked through the studs with respect to the coil bobbin and are biased by the leaf spring toward the lid member.

5 Claims, 17 Drawing Figures

ELECTROMAGNETIC PUMP

BACKGROUND OF THE INVENTION

The present invention relates to an improvement in an electromagnetic pump of a type used for fuel supply in a vehicle.

A simple electromagnetic pump has been desired as a vehicle fuel supply pump which allows easy machining and assembly of the constituting parts and provides stable pumping. Conventional electromagnetic pumps have both advantages and disadvantages and fail to satisfy all the needs described above.

In a conventional electromagnetic pump of this type, a sleeve member is fitted in a cylindrical housing, and a plunger is slidably fitted in the sleeve member. Suction and delivery chambers are formed at the two ends of the sleeve member. An electrical chamber having an excitation coil, a transistor, a printed circuit board, and the like is formed at the center of the sleeve chamber. Thus, the typical conventional electromagnetic pump is of a cylindrical type. In order to simplify the structure of an electromagnetic pump, electromagnetic pumps of a rectangular type are described in Japanese Utility Model Publication Nos. 56-42755 and 57-50542. wherein a sleeve member housing a plunger is disposed in a pump housing formed of a combination of U-shaped housing members. An excitation coil and the like are arranged in the housing.

However, according to the conventional electromagnetic pumps having the structures described above, the number of components is large, and machining and assembly are time-consuming and cumbersome. As a result, a compact, lightweight, low-cost electromagnetic pump cannot be provided.

In the conventional electromagnetic pump described above, a transistor arranged in the electrical chamber is normally fixed by screws or rivets on a heat sink through an insulating mica plate. The resultant assembly is further fixed by rivets on a printed circuit board or other yoke members. With this arrangement, mounting operation is time-consuming and cumbersome. A space for various electronic components mounted on the printed circuit board is limited, so that a sufficient insulating implementation must be provided, thus degrading the operation efficiency. Furthermore, since fastening members such as screws are used for the printed circuit board in the housing, if the printed circuit board is simply housed in the housing, electronic components may be brought into contact with a conductive member, resulting in a short circuit. Therefore, the structure with screws or the like is impractical. In such a structure, excessive stress occurs in each component when the component is mounted on a printed circuit board. The stress may cause the damage to the electronic components. The number of constituting parts is large, many assembly steps are required, and the electromagnetic pump has a large overall size. Furthermore, in order to improve waterproofing, an insulating coating is formed at the junction of the housing members, and a foamed member is filled in the interior of the housing.

Electromagnetic pumps of this type have been mounted in small vehicles with a stroke volume of 1,000 cc, so that a demand has arisen for a compact, lightweight, low-cost pump. No conventional electromagnetic pumps can answer the needs described above and much room is left for implementation to satisfy such requirements.

SUMMARY OF THE INVENTION

It is, therefore, a principal object of the present invention to provide a compact, lightweight, low-cost electromagnetic pump as compared with a conventional pump of this type.

It is another object of the present invention to provide a simple electromagnetic pump with a small number of constituting parts.

It is still another object of the present invention to provide an electromagnetic pump wherein machining and assembly efficiency can be greatly improved and which provides high operation reliability.

It is still another object of the present invention to provide an electromagnetic pump wherein the respective parts are sealed in a pump housing of a simple structure.

In order to achieve the above objects of the present invention, there is provided an electromagnetic pump comprising: a cup-like housing body having an outlet cylindrical portion at a center thereof; a lid member having an inlet cylindrical portion at a center thereof and fixed to the cup-like housing body to constitute a pump housing; a nonmagnetic sleeve member extending between the outlet cylindrical portion and the inlet cylindrical portion; a magnetic plunger slidably fitted in the nonmagnetic sleeve member and having a central through hole; a return spring, arranged between the inlet cylindrical portion and a portion corresponding to the central through hole, for biasing the plunger to a delivery side; inlet and outlet pipes extending through the inlet and outlet cylindrical portions, respectively; a coil bobbin arranged around the sleeve member and wound with an excitation coil having flanges at two ends along an axial direction of the plunger; a transistor assembly consisting of a transistor and a heat sink which are mounted on an outer side surface of one of the flanges of the coil bobbin; a printed circuit board mounted on the transistor assembly and having electronic components cooperating with the transistor and the excitation coil thereon; a holder mounted above the printed circuit board and spaced apart therefrom by a predetermined distance; and a leaf spring arranged between the housing body and the holder; wherein a plurality of studs extend on an outer side surface of the flange of the coil bobbin which has the transistor assembly of the coil bobbin thereon and an inner side surface of the holder, and the transistor assembly, the printed circuit board and the holder are sequentially stacked through the studs with respect to the coil bobbin and are biased by the leaf spring toward the lid member.

DESCRIPTION OF THE PREFERRED EMBODIMENT

The present invention will be described with reference to a preferred embodiment of the present invention in conjunction with the accompanying drawings.

Figure 1:
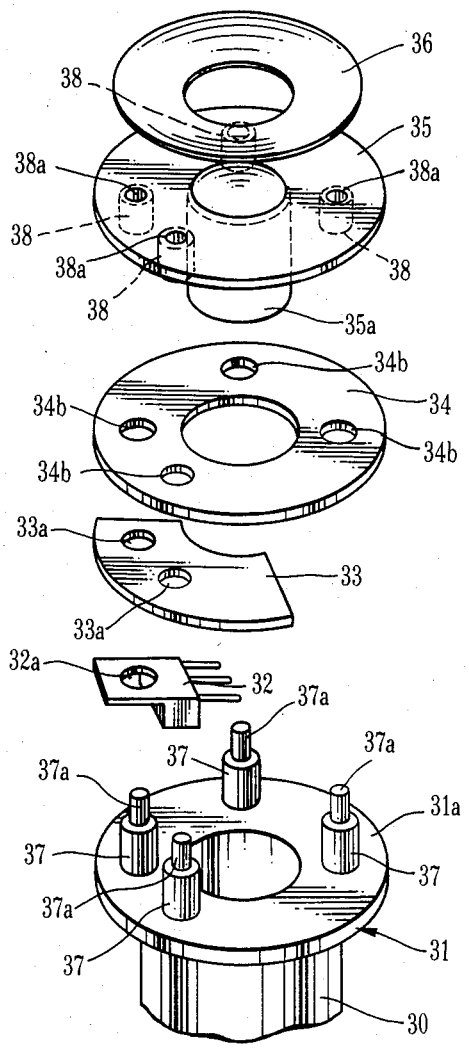
FIG. 1 is a schematic exploded perspective view of pump components stacked in a pump housing of an electromagnetic pump according to an embodiment of the present invention.
Figure 2:
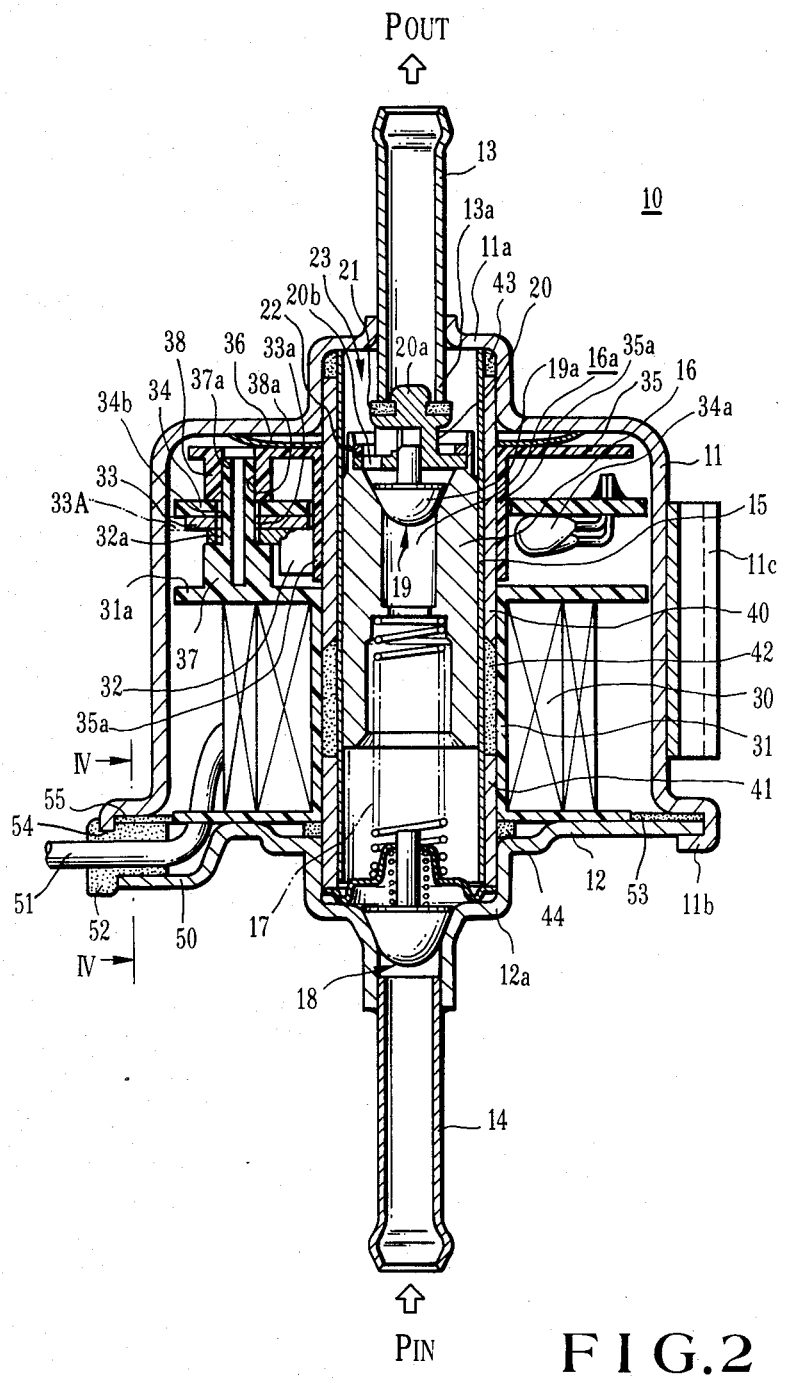
FIG. 2 is a longitudinal sectional view showing an assembly of the electromagnetic pump of FIG. 1.
Figure 3:
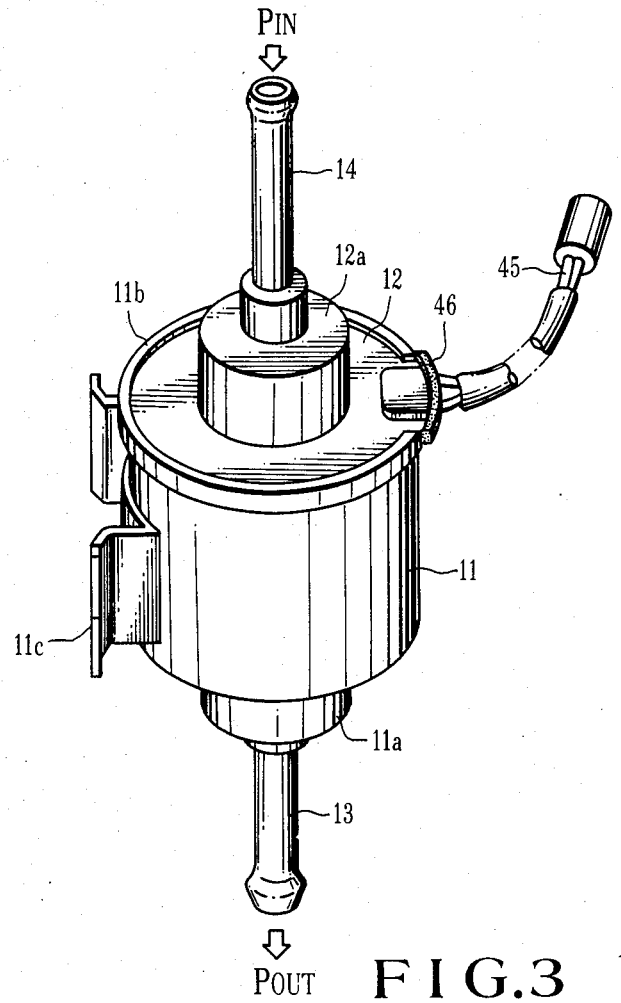
FIG. 3 is a schematic perspective view showing the outer appearance of the electromagnetic pump of FIG. 1.

FIGS. 1 to 3 show an electromagnetic pump according to an embodiment of the present invention. The schematic structure of an electromagnetic pump 10 will be briefly described. An electromagnetic pump 10 has a cup-like housing body 11 and a disk-like lid 12 for closing the opening of the housing body 11. The body 11 and the lid 12 constitute a pump housing. Cylindrical portions 11*a* and 12*a* are formed integrally with the central portion of the bottom (upper side in FIG. 1) of the body 11 and the central portion of the lid 12, respectively. Pipes 13 and 14 constituting fluid outlet and inlet ports are brazed at the centers of the cylindrical portions 11*a* and 12*a*. The body 11 and the lid 12 can be easily formed by pressing metal plates. An edge 11*b* defining the opening of the body 11 is caulked to the lid 12, as shown in FIG. 2. The body 11 and the lid 12 of the pump housing also serve as yokes for forming a magnetic path from an excitation coil (to be described later). An inner space defined by the body 11 and the lid 12 houses mechanical and electrical components of the pump. As shown in FIG. 3, a bracket 11*c* is used to mount the electromagnetic pump 10 to the vehicle body.

A nonmagnetic sleeve member 15 is inserted between the cylindrical portion 11*a* of the body 11 and the cylindrical portion 12*a* of the lid 12. A magnetic plunger 16 with a through hole 16*a* is slidably inserted in the sleeve member 15 and is always biased by a return spring 17 arranged at the inlet port side toward the outlet port of the housing. The spring 17 is mounted at the end of the inlet port of the housing. Reference numeral 18 denotes a suction valve mounted at the inlet end of the sleeve member 15; and 19, a delivery valve mounted at the outlet end of the plunger 16. A valve body 19*a* of the delivery valve 19 is slidably supported in a central cylindrical portion 20*a* of a ring-like member 20 constituting the fuel leakage prevention control valve fixed integrally with the end of the plunger 16. The member 20 has a function of guiding the valve body 19*a* of the delivery valve 19. A rubber or plastic valve seat 21 is disposed at the outer end of the cylindrical portion 20*a* to open/close the inner end of the pipe 13 which extends inside the sleeve member 15 from the outlet port side for a predetermined length. A stopper ring 22 is disposed to fix the member 20 to the end of the plunger 16. The member 20 has four arcuated holes 20*b* to allow fluid to pass therethrough. The holes 20*b* are formed in a peripheral portion of the member 20 at equiangular intervals. The fuel leakage prevention control valve is moved together with the plunger 16 in the sleeve member 15. When the electromagnetic pump is not operated, the control valve closes an inner end 13*a* of the pipe 13 by the biasing force of the return spring 17, thereby properly preventing fluid from leaking to the outlet port and hence providing a practical effect (i.e., guaranteeing safety of the driver and passengers in a vehicle).

According to the present invention, in order to form the control valve, the inner end 13*a* of the delivery pipe 13 extends inside the sleeve member 15 for a predetermined length to form an annular space serving as an annular pulsation absorption chamber 23 around the pipe 13.

A plastic coil bobbin 31 having an excitation coil 30 wound therearound is arranged around the sleeve member 15 housing the plunger 16. A transistor 32 and a heat sink 33 are integrally arranged and spaced apart a predetermined distance from an outer surface portion of a flange 31*a* (upper one in FIG. 1). The transistor 32 partially constitutes an oscillator for flowing a current to the excitation coil 30. A printed circuit board 34 and a holder 35 are spaced apart from each other by a predetermined distance along a direction perpendicular to the surface of the heat sink 33. The printed circuit board 34 has various electronic elements 34*a* such as a resistor and a diode which constitute the oscillator together with the transistor. The stacked assembly of components making up the pump is housed in the body 11 constituting the pump housing such that the front end of the stacked assembly is located at the holder 35 side in the body 11. The assembly is elastically supported in the body 11 by a leaf spring 36 inserted at the bottom of the body 11.

With this arrangement, the assembly of the transistor 32 and the printed circuit board 34 can be simplified, and the electronic elements 34*a* on the printed circuit board 34 will not be short-circuited. The number of constituting members can be decreased, and the respective components are simplified. The electrical chamber constituting elements such as the transistor 32 and the printed circuit board 34 is located in a space (which normally tends to be a dead space) formed above the coil bobbin 31. As a result, a compact, lightweight, low-cost electromagnetic pump can be provided.

A plurality of studs 37 extend on one outer surface of the the flange 31*a* of the coil bobbin 31 to support the transistor 32 and the heat sink 33 as well as the printed circuit board 34 at a predetermined distance from the above-mentioned surface of the flange 31*a*. A plurality of studs 38 extend on the inner side surface of the holder 35 to oppose the studs 37. Reference numeral 37*a* denotes a small-diameter front portion of the stud 37. The small-diameter portion 37*a* is inserted into holes 32*a*, 33*a* and 34*b* which are respectively formed in the transistor 32, the heat sink 33 and the printed circuit board 34 to inhibit their movement along the radial direction of the pump. Furthermore, each small-diameter portion 37*a* is inserted into a hole 38*a* formed in the corresponding stud 38 at the side of the holder 35, thereby forming the assembly as an integral body.

In this embodiment, the printed circuit board 34 and the holder 35 have substantially a ring-like shape which matches with the coil bobbin 31. The heat sink 33 has a sector-shaped member of a size sufficient to allow mounting of the transistor 32 on the printed circuit board 34.

With the above arrangement, the transistor 32, the heat sink 33, the printed circuit board 34 and the holder 35 are sequentially stacked on the studs 37 extending upward from the outer surface of the flange 31*a* of the coil bobbin 31. The sleeve member 15 extends through the central portion while the respective members are spaced apart by the studs 37 and 38. These constituting members are housed in the housing body 11 through the leaf spring 36 inserted between the members and the bottom of the housing body 11. The lid 12 is mounted on the housing body 11, and the edge 11*b* of the housing body 11 is caulked to fix the lid 12 integrally with the housing body 11, thereby completing assembly of the electromagnetic pump as a simple structure and independently locating the respective components. In such an assembly state, the stacked members are biased toward the lid 12 by the leaf spring 36 inserted between the members and the holder 35 at the bottom of the housing body 11.

In the electromagnetic pump 10 having the structure described above, the pump housing comprises the cup-like housing body 11 and the lid 12 for closing the opening of the housing body 11. The constituting members are then stacked in the interior of the housing body 11, thereby simplifying the structure, as well as machining and assembly.

According to the electromagnetic pump 10 assembled in the manner described above, a fixing force for each constituting member in the pump housing is obtained by the biasing force of the leaf spring 36. The spring force can be freely selected, and no local excessive stress acts on any one constituting member.

Rotation of the stacked assembly including the coil bobbin 31 housed in the pump housing is prevented by utilizing a frictional force between the adjacent members or by providing an anti-rotational engaging member between the coil bobbin 31 and the lid 12. With this arrangement, the heat sink 33 can be brought into contact with the inner wall of the body 11 so as to allow proper heat radiation of the transistor 32, as indicated by a broken line 33A of FIG. 2.

A pair of magnetic cylinders 40 and 41 are arranged along the axial direction to form a magnetic path from the excitation coil 30. The magnetic cylinders 40 and 41 are sandwiched between the outer surface of the sleeve member 15 housing the plunger 16 and the inner surface of the coil bobbin 31 having the excitation coil wound therearound. The magnetic cylinders 40 and 41 comprise coiled bushes or split bushes obtained by bending a plate material, thereby simplifying machining and assembly. Seal members 42, 43 and 44 are properly inserted between the inner path of the sleeve member 15 and the inner space of the pump housing to block fuel, so that a complete seal can be obtained.

Figure 4:
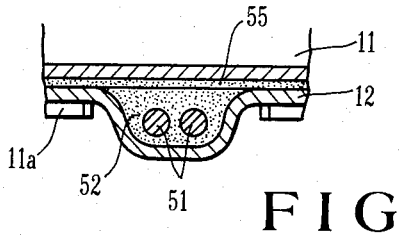
FIG. 4 is a sectional view of the electromagnetic pump taken along the line VI—VI of FIG. 2.

In the electromagnetic pump 10 having the above structure, the pump housing is constituted by the cup-like housing body 11 and the lid 12 caulked at the edge 11*b* of the housing body 11. An expanded portion 50 is opened at least one (the edge of the lid 12 in this embodiment) of the edge of the lid 12 and the edge 11*b* of the housing body 11, as shown in FIGS. 2 and 4. A grommet 52 for holding lead wires 51 extending outside the housing is clamped between the expanded portion 50 and the edge of an opposing member (the edge 11*b* of the housing body 11).

In other words, the pump housing is constituted by the housing body 11 and the lid 12, and the lead wires 51 extending outside the housing are sealed at the caulked portion between the housing body 11 and the lid 12, thereby guaranteeing waterproofing. Unlike in the conventional pump, coating or filling of the foamed material can be eliminated.

Figure 5:
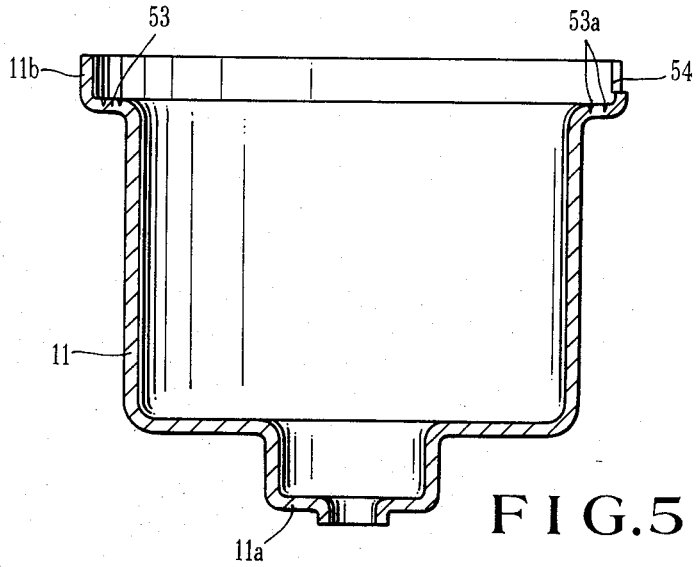
FIGS. 5, 6 and 7 are respectively longitudinal sectional views of a housing body constituting the pump housing.
Figure 6:
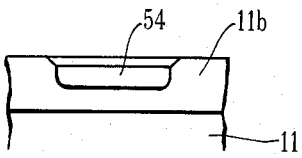
Figure 7:
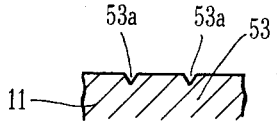

According to this embodiment, the housing body 11 has a cup-like shape, as is apparent from FIGS. 5, 6 and 7. The edge 11*b* has a stepwise gasket mounting portion 53 which is flared outward. A notch 54 cut upward is formed in part of the edge 11*b*. The gasket mounting portion 53 has a surface flared downward. A V-shaped annular groove 53*a* is formed in the surface of the flared surface. As shown in FIG. 2, a gasket 55 is mounted on the housing portion 53, and the lid 12 is placed on the gasket and is caulked. In this case, the gasket 55 will not deviate or move due to the structure described above. As a result, sealing between the housing body 11 and the lid 12 can be guaranteed.

Figure 8:
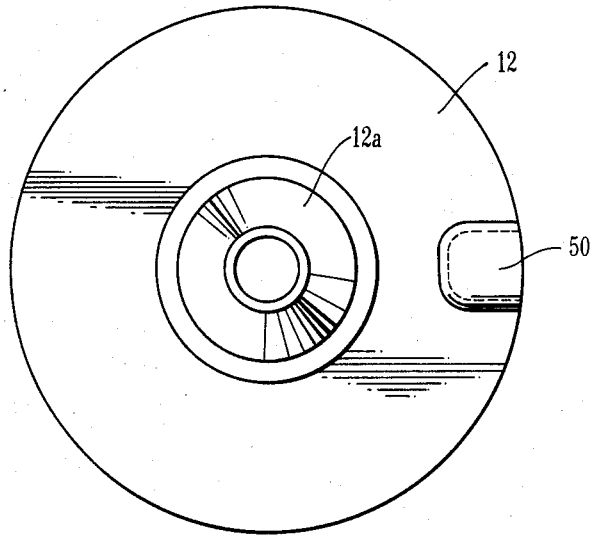
FIGS. 8, 9 and 10 are respectively a plan view and a sectional view of a lid and an enlarged view of an expanded portion.
Figure 9:
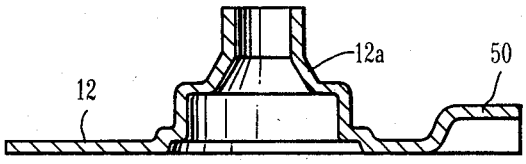
Figure 10:
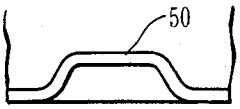
Figure 11:
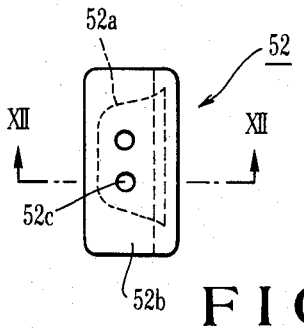
FIGS. 11, 12 and 13 are respectively a side view of a grommet, a sectional view thereof along the line XII—XII of FIG. 11, and a plan view thereof.
Figure 12:
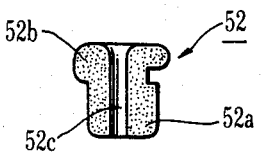
Figure 13:
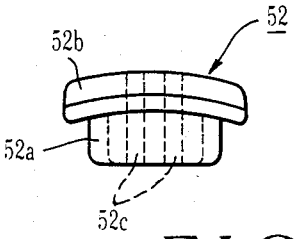

As is apparent from FIGS. 8, 9 and 10, the expanded portion 50 is open at a part of the edge of the lid 12 so as to correspond to the notch 54 formed in the housing body 11.

The grommet 52 inserted between the notch 54 of the housing body 11 and the expanded portion 50 of the lid 12 to seal and guide the lead wires 51 comprises a portion 52*b* clamped in the housing and a portion 52a locked outside the housing. A through hole 52*c* is formed in the center of the grommet 52.

With the above arrangement, an appropriate clamping margin is given to the gasket 55 and the grommet 52 to properly seal between the housing body 11 and the lid 12. Thus, the lead wires 51 can be suitably led outside the housing while the pump housing is maintained sealed.

In the above embodiment, the expanded portion 50 for clamping the grommet 52 is formed at the side of the cover 12. However, the present invention is not limited the above arrangement. An expanded portion may be formed only in the housing body 11 or in both the housing body 11 and the lid 12. It is essential to form the expanded portion radially open at at least one of the edges of the Iousing body and the lid and to clamp the grommet for holding the lead wires led outside the housing.

The electromagnetic pump 10 has the overall structure as described above. An on/off current generator for supplying an on/off current to the excitation coil 30 will be described.

Figure 14:
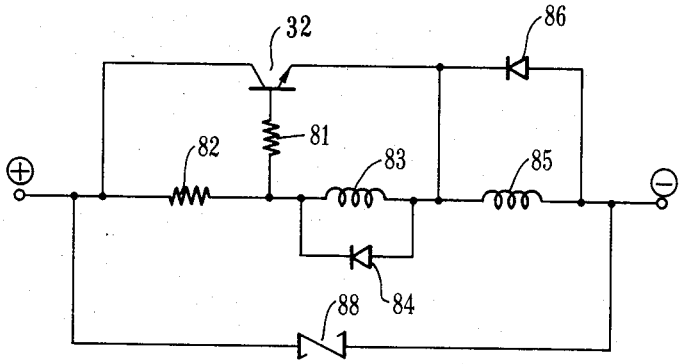
FIG. 14 is a circuit diagram of an on/off current generator in the electromagnetic pump of FIG. 1.

FIG. 14 is a circuit diagram showing an arrangement of an on/off current generator. Reference numeral 81 denotes a protecting resistor for preventing a large current from flowing through the transistor 32 in a power source reverse connection; 82, a bias resistor; 83, a signal coil; 84, a diode; 85, a main coil; 86, a diode; and 88, a surge absorber.

The transistor used in this on/off current generator has a large heat dissipation and is mounted on a heat sink. In order to decrease a thermal resistance, the heat sink is mounted on the inner wall surface of the housing of the electromagnetic pump. Since vehicles are normally negatively grounded, the heat sink is set at ground potential. When a pnp power transistor is used, an insulating plate need not be used. In this case, the pnp power transistor can be directly mounted on the heat sink, thereby decreasing the number of mounting steps and the number of constituting members. However, the pnp power transistor is expensive, and the overall arrangement results in high cost.

In the on/off current generator described above, an inexpensive npn transistor is used. However, when an npn transistor is used, an insulating plate must be inserted between the transistor and the heat sink, and the number of manufacturing steps is increased. However, since the pellet of the transistor 32 is an insulating molded member, the inexpensive transistor 32 can be used and directly mounted on the heat sink. As a result, the cost of the transistor, mounting cost and number of manufacturing steps can be decreased, thus providing a great economical advantage.

In order to protect the transistor 32 from a surge voltage, the surge absorber 88 is connected in parallel with the power source to absorb the surge voltage. This surge absorber has a better surge absorption property than the Zener diode. However, when a surge voltage higher than a maximum surge capacity is applied to the surge absorber, it is short-circuited and burned out. For this reason, the width of part of the pattern connected to the surge absorber 88 is decreased, as indicated by arrow A in FIG. 15. When a large current flows, the narrowed portion is fused to disconnect the surge absorber 88 from the on/off current generator, thereby preventing the absorber 88 from being burned out.

Figure 15:
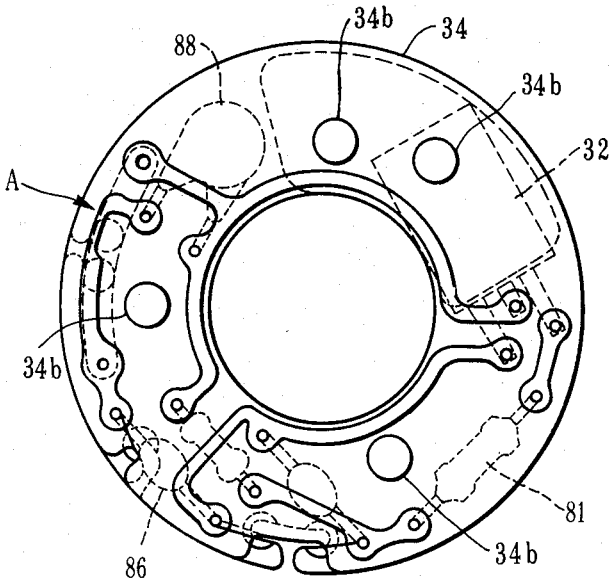
FIG. 15 is a plan view of a printed circuit board in the electromagnetic pump of FIG. 1.

When the circuit of FIG. 14 is connected to the power source, the polarities of the terminals must be checked, as shown in FIG. 15. When the polarities of the terminals are reversed, a large current flows in the emitter-base path of the transistor 32 through the diode 86, and the transistor 32 is instantaneously damaged. In order to prevent this, the resistor 81 is connected to the base of the transistor 32 to limit the current to a value lower than the secondary breakdown voltage of the transistor.

In the circuit of FIG. 14, the signal coil 83 is connected in parallel with the main coil 85 to cause blocking oscillation.

Figure 16:
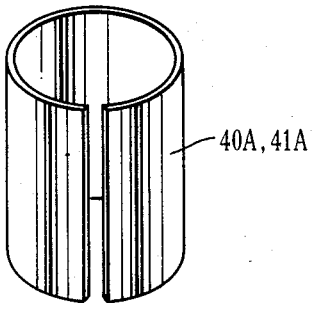
FIGS. 16. and 17 are perspective views showing modifications of a magnetic cylinder in the electromagnetic pump of FIG. 1.
Figure 17:
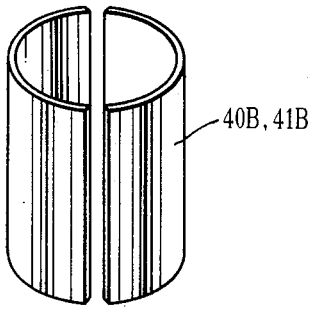

In the electromagnetic pump 10 having the arrangement described above, a pair of magnetic cylinders 40 and 41 are arranged along the axial direction to form a magnetic path from the excitation coil 30. The magnetic cylinders 40 and 41 are sandwiched between the outer surface of the sleeve member 15 housing the plunger 16 and the inner surface of the coil bobbin 31 having the excitation coil 30 wound therearound. As shown in FIGS. 16 or 17, the magnetic cylinders 40 and 41 comprise coiled bushes 40A and 41A or split sleeves 40B and 41B obtained by bending a plate material, thereby simplifying machining and assembly. Seal members 42, 43 and 44 are properly inserted between the inner path of the sleeve member 15 and the inner space of the pump housing to block fuel, so that a complete seal can be obtained.

The above-mentioned magnetic cylinders are inserted between the outer surface of the sleeve member 15 and the inner surface of the coil bobbin 31 from both ends, and the plunger 16 therein is reciprocally moved by a magnetic force of the excitation coil 30. When the magnetic cylinders comprise conventional cylindrical members obtained by cutting, machining is time-consuming and cumbersome, and precision machining cannot be performed, resulting in high cost. The present invention eliminates such drawbacks. When the coiled or split bushes easily obtained by winding a plate member are used, machining can be greatly facilitated, high precision machining is not required, and assembly is simplified. As a result, the electromagnetic pump can be manufactured at low cost.

When the coiled or split bush is used as the magnetic cylinder, a gap is formed along the axial direction thereof and a fluid flowing through the sleeve member 15 leaks into the pump housing. In order to solve this problem, a cylindrical seal member 42 shown in FIG. 2 is mounted on the outer surface of the sleeve member 15, and the magnetic cylinders 40 and 41 are inserted in the sleeve member 15 from the both ends, thereby guaranteeing the seal between the sleeve member 15 and the coil bobbin 31. At the same time, seal members 43 and 44 such as O-rings are inserted at the two ends of the sleeve member 15 between the housing body 11 and the lid 12 which constitute the pump housing. As a result, complete sealing can be achieved.

With this arrangement, the magnetic cylinders 40 and 41 can comprise only the coiled or split bushes obtained by winding a plate member, so that machining can be simplified. Even if a small gap is formed along the axial direction of the bush, no problem occurs. High precision is not required in production, assembly efficiency can be greatly improved, and the manufacturing cost can be significantly decreased.

With the above arrangement, when at least one of the magnetic cylinders 40 and 41 is engaged with the cylindrical portions 11*a* and 12*a* of the housing body 11 and the lid 12 which hold the two ends of the sleeve member 15 to form a gap between the cylindrical portions 11*a* and 12*b*, concentric and parallel errors between the housing body 11 and the lid 12 can be absorbed. Sticking of the plunger 16 which is caused by deformation of the sleeve member 15 can be prevented.

In the electromagnetic pump 10 having the structure described above, in addition to the magnetic cylinders 40 and 41 comprising coiled or split bushes, magnetic disks may be disposed at the two ends of the coil bobbin 31. The plunger 16 can then be more effectively driven with good magnetic efficiency.

According to the embodiment described above, the lid is caulked to the housing body. However, the present invention is not limited to this fixing means, but can be extended to screwing or press fit.

According to the housing structure of the electromagnetic pump of the present invention, the cup-like housing body housing the pump constituting members is caulked to the lid at the open edge of the housing body. The expanded portion radially opened at the edge of the lid is provided, and the grommet for holding the lead wires led outside the housing body is clamped between the expanded portion and the edge of the housing member. Although the electromagnetic pump has a simple structure, complete sealing is achieved at the respective components of the pump housing including the lead wire clamping portion. Unlike in the conventional electromagnetic pump, cumbersome operation is not required, and the structure and machining of the respective components can be simplified to achieve compactness, lightweight, and other practical advantages.

According to the electromagnetic pump of the present invention as can be apparent from the above description, the pump housing is constituted by the cup-like housing body and the lid for closing the opening of the housing body. The pump constituting members are stacked inside the housing body. Even if the housing has a simple structure, the structure and machining of the respective components can be simplified, and the manufacturing cost can be greatly decreased, thus providing great practical advantages.

In particular, according to the present invention, since the pump constituting members are stacked in the pump housing to eliminate screwing and caulking as conventionally required, the number of constituting members can be decreased, assembly can be simplified, and deformation caused by excessive fastening and caulking can be prevented. The pellet will not crack due to deformation of the heat sink of the transistor. Furthermore, the printed circuit board will not crack, disconnections of the wiring pattern will not occur, and short-circuiting caused by attachment of solder to a screw or the like is prevented.

According to the present invention, the constituting elements mounted on the printed circuit board are located so as to effectively utilize the dead space, and dimension along the radial direction can be decreased as compared with the conventional rectangular type pump having the electrical components located at the side of the spool, thereby obtaining a compact pump.

According to the present invention, the npn transistor less expensive than the pnp transistor is used, and it has a molded structure and can be directly mounted on the heat sink. The insulating plate can be omitted, so that the number of mounting steps and cost required therefor can be decreased. As a result, an inexpensive electromagnetic pump can be provided.

According to the electromagnetic pump of the present invention, the pair of magnetic cylinders are arranged along the axial direction to form a magnetic path from the excitation coil. The magnetic cylinders are sandwiched between the outer surface of the sleeve member housing the plunger and the inner surface of the coil bobbin having the excitation coil wound therearound. The magnetic cylinders comprise coiled bushes or split sleeves obtained by bending a plate material, thereby simplifying machining and assembly. Seal members are properly inserted between the inner path of the sleeve member and the inner space of the pump housing to block fuel, so that a complete seal can be obtained. Therefore, the electromagnetic pump has a simple structure, and machining and assembly of the magnetic cylinders can be greatly simplified to decrease the manufacturing cost. The respective components can be sealed by simple sealing members to hermetically isolate the fluid path portion from the electrical chamber portion, and proper pumping can be achieved.

What is claimed is:

1. An electromagnetic pump comprising:

a cup-like housing body having an outlet cylindrical portion at a center thereof;

a lid member having an inlet cylindrical portion at a center thereof and fixed to said cup-like housing body to constitute a pump housing;

a nonmagnetic sleeve member extending between said outlet cylindrical portion and said inlet cylindrical portion;

a magnetic plunger slidably fitted in said nonmagnetic sleeve member and having a central through hole;

a return spring, arranged between said inlet cylindrical portion and a portion corresponding to said central through hole, for biasing said plunger to a delivery side;

inlet and outlet pipes extending through said inlet and outlet cylindrical portions, respectively;

a coil bobbin arranged around said sleeve member and wound with an excitation coil having flanges at two ends along an axial direction of said plunger;

a transistor assembly consisting of a transistor and a heat sink which are mounted on an outer side surface of one of said flanges of said coil bobbin;

a printed circuit board mounted on said transistor assembly and having electronic components cooperating with said transistor and said excitation coil thereon;

a holder mounted above said printed circuit board and spaced apart therefrom by a predetermined distance; and a leaf spring arranged between said housing body and said holder;

wherein a plurality of studs extend on an outer side surface of said flange of said coil bobbin which has said transistor assembly of said coil bobbin thereon and an inner side surface of said holder, and said transistor assembly, said printed circuit board and said holder are sequentially stacked through said studs with respect to said coil bobbin and are biased by said leaf spring toward said lid member.

2. A pump according to claim 1, wherein said holder has a cylindrical portion which surrounds said sleeve member and extends toward said coil bobbin.

3. A pump according to claim 1, further comprising:

a pair of magnetic cylinders being inserted from two ends along an axial direction of said sleeve member and being located so as to be spaced apart from each other by a distance formed between an inner peripheral surface of said coil bobbin so as to form a magnetic flux path of said excitation coil;

a seal member disposed between said pair of magnetic cylinders; and another seal member for sealing between an internal path of said sleeve member and an internal space of said pump housing;

wherein said pair of magnetic cylinders comprise coiled bushes or split sleeves obtained by bending plate members, respectively.

4. A pump according to claim 1, wherein there is provided an expanded portion radially open at at least one of the edges of said housing body and said lid member, said expanded portion being adapted to clamp, together with a portion opposite thereto, a grommet for holding lead wires led outside said housing and being clamped between said expanded portion and a portion opposite thereto; and wherein said lid member is caulked at an edge of an opening of said cup-like housing body.

5. A pump according to claim 1, wherein said transistor comprises an N-P-N transistor which constitutes an on/off current generator for supplying an on/off current to said excitation coil, and wherein said heat sink of said transistor assembly is in contact with an inner wall surface of said pump housing, wherein said N-P-N transistor has an insulating structure, said insulating structure and said N-P-N transistor being directly mounted on said heat sink.

* * * * *

UNITED STATES PATENT AND TRADEMARK OFFICE

CERTIFICATE OF CORRECTION

PATENT NO. :4,643,653

DATED :2/17/87

INVENTOR(S) :Masaka et al.

It is certified that error appears in the above-identified patent and that said Letters Patent is hereby corrected as shown below:

| COLUMN | LINE | DESCRIPTION |
|---|---|---|
| 6 | 44 | delete "Iousing" insert--housing-- |

Signed and Sealed this

Twelfth Day of July, 1988

*Attest:*

*Attesting Officer*

DONALD J. QUIGG

*Commissioner of Patents and Trademarks*